US009670730B2

(12) United States Patent
Larsen et al.

(10) Patent No.: US 9,670,730 B2
(45) Date of Patent: Jun. 6, 2017

(54) METHOD OF PROVIDING MECHANICAL STABILITY AROUND AN ENTRANCE OF A NEW WELL PATH TO BE FORMED FROM AN EXISTING WELL

(71) Applicant: Hydra Systems AS, Tananger (NO)

(72) Inventors: Arne Gunnar Larsen, Sandnes (NO); Patrick Andersen, Hafrsfjord (NO); Roy Inge Jensen, Stavanger (NO); Arnt Olav Dahl, Randaberg (NO); Morten Myhre, Tananger (NO)

(73) Assignee: Hydra Systems AS, Tananger (NO)

( * ) Notice: Subject to any disclaimer, the term of this patent is extended or adjusted under 35 U.S.C. 154(b) by 248 days.

(21) Appl. No.: 14/375,093

(22) PCT Filed: Feb. 13, 2013

(86) PCT No.: PCT/NO2013/050029

§ 371 (c)(1),
(2) Date: Jul. 28, 2014

(87) PCT Pub. No.: WO2013/122480

PCT Pub. Date: Aug. 22, 2013

(65) Prior Publication Data

US 2015/0007991 A1 Jan. 8, 2015

(30) Foreign Application Priority Data

Feb. 17, 2012 (NO) ..... 20120169

(51) Int. Cl.
*E21B 7/08* (2006.01)
*E21B 7/06* (2006.01)
(Continued)

(52) U.S. Cl.
CPC ..... *E21B 7/061* (2013.01); *E21B 29/02* (2013.01); *E21B 29/06* (2013.01);
(Continued)

(58) Field of Classification Search
None
See application file for complete search history.

(56) References Cited

U.S. PATENT DOCUMENTS 4,484,625 A * 11/1984 Barbee, Jr. ..... E21B 37/08 166/185
5,277,251 A 1/1994 Blount et al.
(Continued)

FOREIGN PATENT DOCUMENTS

EP 0690201 1/1996
NO 20111641 7/2012
(Continued)

OTHER PUBLICATIONS

International Search Report and Written Opinion for PCT/NO2013/050015 dated May 6, 2013.
(Continued)

*Primary Examiner* — Taras P Bemko
*Assistant Examiner* — Brandon Duck
(74) *Attorney, Agent, or Firm* — Andrus Intellectual Property Law, LLP

(57) ABSTRACT

A method is for establishing a new well path from an existing well, wherein the existing well, at least in a portion where the new well path is to be established, is delineated radially by a casing. The method comprises disposing and anchoring a plug base in the well; providing a plug above the plug base in the well and along a longitudinal section thereof, wherein the plug, at least in a portion thereof, covers substantially the entire cross-section of the well; removing a portion of the plug in such a manner that at least a cross-sectional section of the plug remains on the outside of the casing; disposing and anchoring a direction-guiding element in the well, and at least partially within the longitudinal section; and with the direction-guiding element, guiding a drilling tool against the inside of the casing in the existing
(Continued)

well path in order to form a hole through the casing, and through the remaining cross-sectional section of the plug within the longitudinal section, which opens up to formation of a new well path. The method also comprises conducting a perforation tool down into the casing and to the longitudinal section where the plug is to be set; forming holes in the casing and along the longitudinal section by means of the perforation tool; and pumping a fluidized plugging material down through the string and out into the casing, thus also into the annulus via the holes in the casing.

13 Claims, 8 Drawing Sheets

(51) Int. Cl.

| | |
|---|---|
| ***E21B 33/14*** | (2006.01) |
| ***E21B 29/06*** | (2006.01) |
| ***E21B 37/00*** | (2006.01) |
| ***E21B 43/11*** | (2006.01) |
| ***E21B 29/02*** | (2006.01) |
| ***E21B 33/12*** | (2006.01) |
| ***E21B 37/08*** | (2006.01) |

(52) U.S. Cl.
CPC ..... *E21B 33/1204* (2013.01); *E21B 33/14* (2013.01); *E21B 37/00* (2013.01); *E21B 37/08* (2013.01); *E21B 43/11* (2013.01)

(56) References Cited

U.S. PATENT DOCUMENTS

| | | | | |
|---|---|---|---|---|
| 5,301,760 | A | 4/1994 | Graham | |
| 5,423,387 | A * | 6/1995 | Lynde | E21B 7/061 166/117.5 |
| 5,431,219 | A | 7/1995 | Leising et al. | |
| 5,435,400 | A | 7/1995 | Smith | |
| 5,584,350 | A | 12/1996 | Schnitker et al. | |
| 2002/0162657 | A1 * | 11/2002 | Tumlin | E21B 33/134 166/285 |
| 2009/0032257 | A1 | 2/2009 | Rayssiguier et al. | |
| 2010/0025036 | A1 | 2/2010 | Gambier et al. | |
| 2013/0312963 | A1 * | 11/2013 | Larsen | E21B 33/13 166/285 |

FOREIGN PATENT DOCUMENTS

| | | | |
|---|---|---|---|
| WO | 0070183 | 11/2000 | |
| WO | WO 0070183 A1 * | 11/2000 | E21B 7/061 |
| WO | 2011074981 | 6/2011 | |
| WO | 2012128644 | 9/2012 | |

OTHER PUBLICATIONS

International Preliminary Report on Patentability for PCT/NO2013/050015 dated Jan. 31, 2014.
Response to Written Opinion for PCT/NO2013/050015 dated Oct. 31, 2013.
International Search Report and Written Opinion for PCT/NO2013/050029 dated May 24, 2013.

* cited by examiner

METHOD OF PROVIDING MECHANICAL STABILITY AROUND AN ENTRANCE OF A NEW WELL PATH TO BE FORMED FROM AN EXISTING WELL

CROSS-REFERENCE TO RELATED APPLICATIONS

This application is the U.S. national stage application of International Application PCT/NO2013/050029, filed Feb. 13, 2013, which international application was published on Aug. 22, 2013, as International Publication WO2013/122480 in the English language. The international application is incorporated herein by reference, in entirety. The international application claims priority to Norwegian Patent Application No. 20120169, which is incorporated herein by reference.

FIELD

The invention concerns a method for establishment of a new well path from an existing well. More specifically, the invention concerns a method which provides mechanical stability in the form of a well plug formed around the entrance of the new well path being formed through an opening in an existing casing.

BACKGROUND

It is known to form new well paths, sidetracks, from an existing well by drilling a new well path out through the wall of a casing. This is carried out by anchoring a whipstock at a desired location in the well, whereby a drilling body, which is brought into engagement with the whipstock, changes direction and drills from the inside and through the sidewall of the casing. Oftentimes, such a drilling operation leaves an oblong opening, a window, in the wall of the casing. It is customary to form such a sidetrack at a relatively shallow level in a well, and far away from the reservoir, so as to ensure that the casing, which is to be drilled through, is cemented to the surrounding formation. By so doing, the window becomes sufficiently stable, thereby ensuring that there is no danger of the portion having the window being allowed to rotate during subsequent operations, for example when the drill string is pulled back through the window. Given that the sidetrack is formed at a relatively shallow level in the well, the new well path oftentimes becomes very long, which incurs large costs to an operator.

SUMMARY

The object of the invention is to remedy or to reduce at least one of the disadvantages of the prior art, or at least to provide a useful alternative to the prior art.

The object is achieved by virtue of features disclosed in the following description and in the subsequent claims.

More specifically, the invention concerns a method for establishment of new well path from an existing well, wherein the existing well, at least in a portion where the new well path is to be established, is delineated radially by a casing, and wherein the method is characterized in that it comprises the following steps:

(A) disposing and anchoring a plug base in the well;

(B) providing a plug above the plug base in the well along a longitudinal section, wherein the plug, at least in a portion, covers substantially the entire cross-section of as the well;

(C) removing a portion of the plug in such a manner that at least a cross-sectional section of the plug remains on the outside of the casing;

(D) disposing and anchoring a direction-guiding element in the well at least partially within the longitudinal section; and (E) by means of the direction-guiding element, guiding a drilling tool against the inside of the casing in the well in order to form a hole through the casing and the remaining cross-sectional section of the plug within the longitudinal section, which opens up to formation of a new well path, characterized in that step (B) also comprises the following sub-steps:

(B1) conducting a perforation tool down into the casing and to the longitudinal section where the plug is to be set;

(B2) forming holes in the casing and along the longitudinal section by means of the perforation tool; and (B5) pumping a fluidized plugging material down through the string and out into the casing, thus also into the annulus via the holes in the casing.

For example, the plug may be established by means of a method and devices as disclosed in Norwegian patent application 20111641 bearing the title "Method for combined cleaning and plugging in a well, a washing tool for directional washing, and use of the washing tool", and in Norwegian patent application 20110450 bearing the title "Apparatus for positive drive of liquid, permanent plugging material through a perforated casing in oil or gas wells", both of which have been filed by the present applicant.

The remaining cross-sectional section of the plug may contribute to provide a good base around the hole in the casing, and at the entrance of the new well path.

In one embodiment, step (C) may include removing a portion of the plug in such a manner that also a longitudinal section of the plug remains centrally in the well and within the casing. This will have the advantage of allowing the remaining longitudinal section of the plug to be used as a base for various tools and equipment desired to be placed permanently or temporarily in the well. It may be a direction-guiding element, for example a whipstock or similar.

In a further embodiment, the longitudinal section remaining centrally in the well may constitute less than half of the longitudinal section along which the plug was set.

Step (C) may include removing the portion of the plug by means of drilling.

In one embodiment, the plug may be formed from a fluidized plugging material comprising cement slurry.

In another embodiment, the plug may be formed from a fluidized plugging material comprising a particulate mass.

In yet another embodiment, step (B), and between sub-steps (B2) and (B5), may also include the following sub-steps:

(B3) by means of a washing tool, which is attached to a flow-through string and is conducted down to the longitudinal section, pumping a washing fluid down through the string and out into the casing via the washing tool; and (B4) by means of a directional means connected to the washing tool, conducting the washing fluid out into an annulus between the outside of the casing and the surrounding formation.

It may be of advantage to use a displacement body in the form of a pressing apparatus, as described in said Norwegian patent application 20110450, to further displace and distribute the fluidized plugging material in the casing and further out into the annulus.

In one embodiment, the steps of perforating and washing may be carried out in separate trips down into the well.

In another embodiment, the steps of perforating and washing may be carried out in one and the same trip down into the well. This, for example, may be carried out in the manner described in the above-mentioned Norwegian patent publication 20111641, and by virtue of the perforation tool and the washing tool being connected to the same string. The perforation tool may also be releasably connected to the washing tool.

In one embodiment, the method may further comprise a step of leaving the perforation tool in the well. This may prove particularly appropriate if the perforation tool is drillable and/or may be left in a suitable place in the well.

In another embodiment, the method may also comprise a step of leaving the washing tool in the well. This may prove particularly appropriate if the washing tool is drillable and/or may be left in a suitable place in the well.

After step (E), the method may also comprise a step of drilling out a new well path via said hole formed through the casing.

A use of a cement plug as a base for a whipstock in a subterranean well is also described.

BRIEF DESCRIPTION OF THE DRAWINGS

Hereinafter, an example of an embodiment is described and is depicted in the accompanying drawings, where.

DETAILED DESCRIPTION OF THE DRAWINGS

Figure 1:
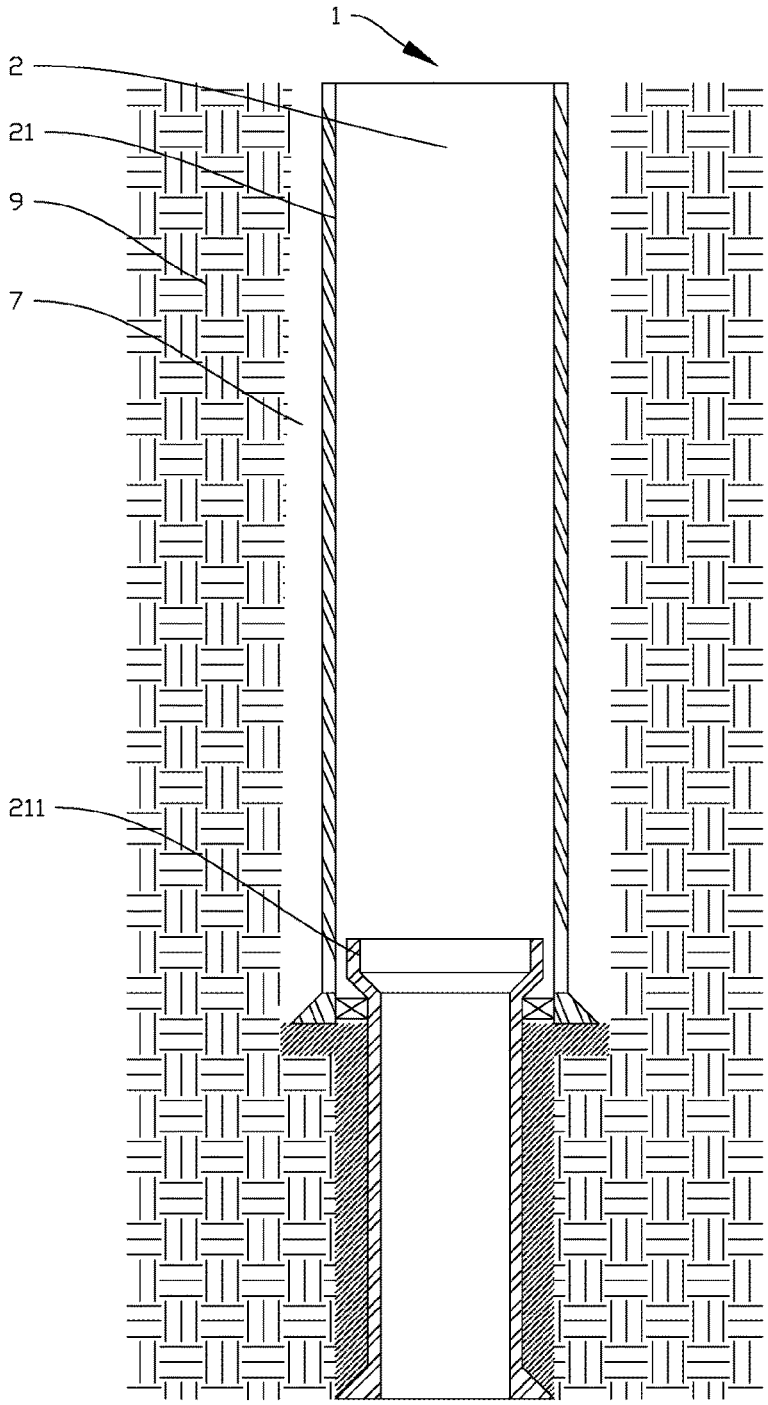
FIG. 1 shows, as viewed from the side, a simplified and schematic section of a well.

In the following, reference numeral 1 denotes a well as used in context of the method of the present invention. The well 1 is depicted in a simplified and schematic manner, and elements not being central to the invention may be left out from the Figures.

FIG. 1 shows the well 1 having an existing well path 2 lined with a casing 21 in an upper portion of the well 1, and having a production liner 211 extending from a lower portion of the casing 21 and further down into the well 1 along the well path 2. An annulus 7 filled with a fluid and/or a deposited solid (not shown) is located between the casing 21 and a surrounding formation 9.

Figure 2:
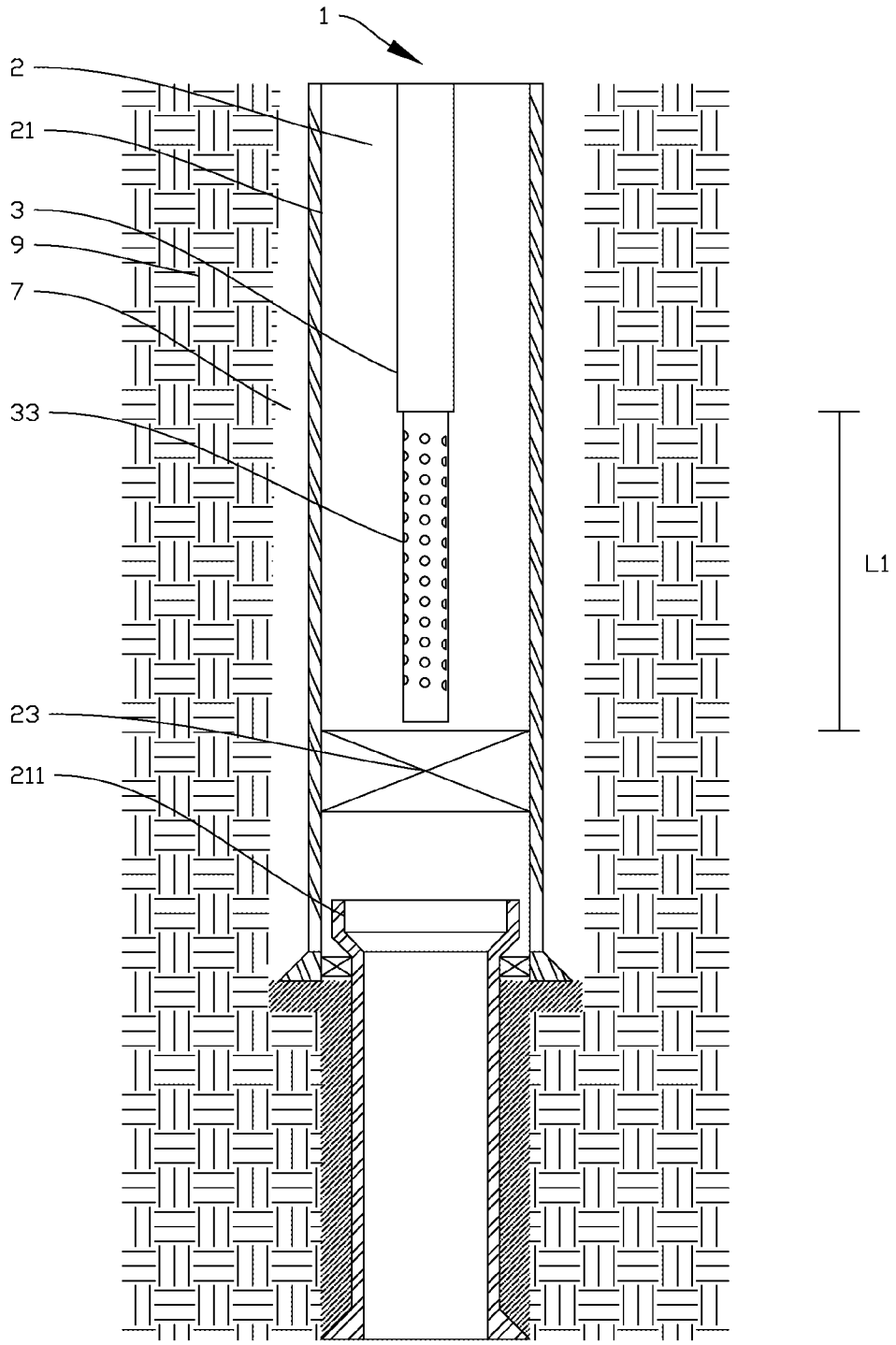
FIG. 2 shows, as viewed from the side, the well after having set a plug base in the well and a string with a perforation tool has been conducted down into the well.

FIG. 2 shows the well 1 after having conducted a perforation tool 33 down into the well 1 within the casing 21 and on a string 3, and after having set a plug base 23 in the well 1. The perforation tool 33 is positioned above the plug base 23 and along a longitudinal section L1 of the well 1 within which plugging is desired.

Figure 3:
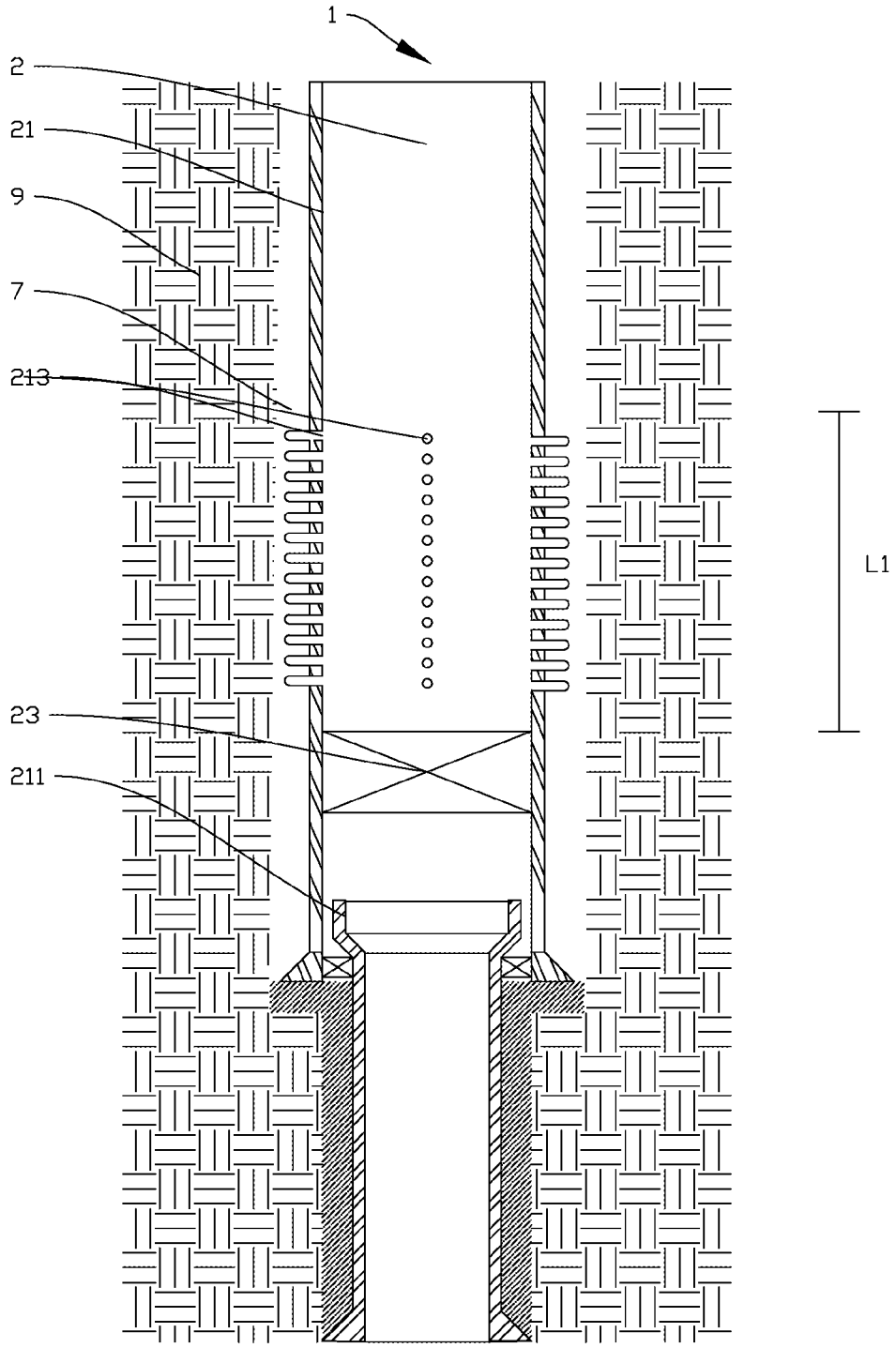
FIG. 3 shows, as viewed from the side, the well after the perforation tool has formed holes in a casing.

FIG. 3 shows the well 1 after having formed, by means of the perforation tool 33, several holes 213 in the casing 21 along the longitudinal section L1.

Figure 4:
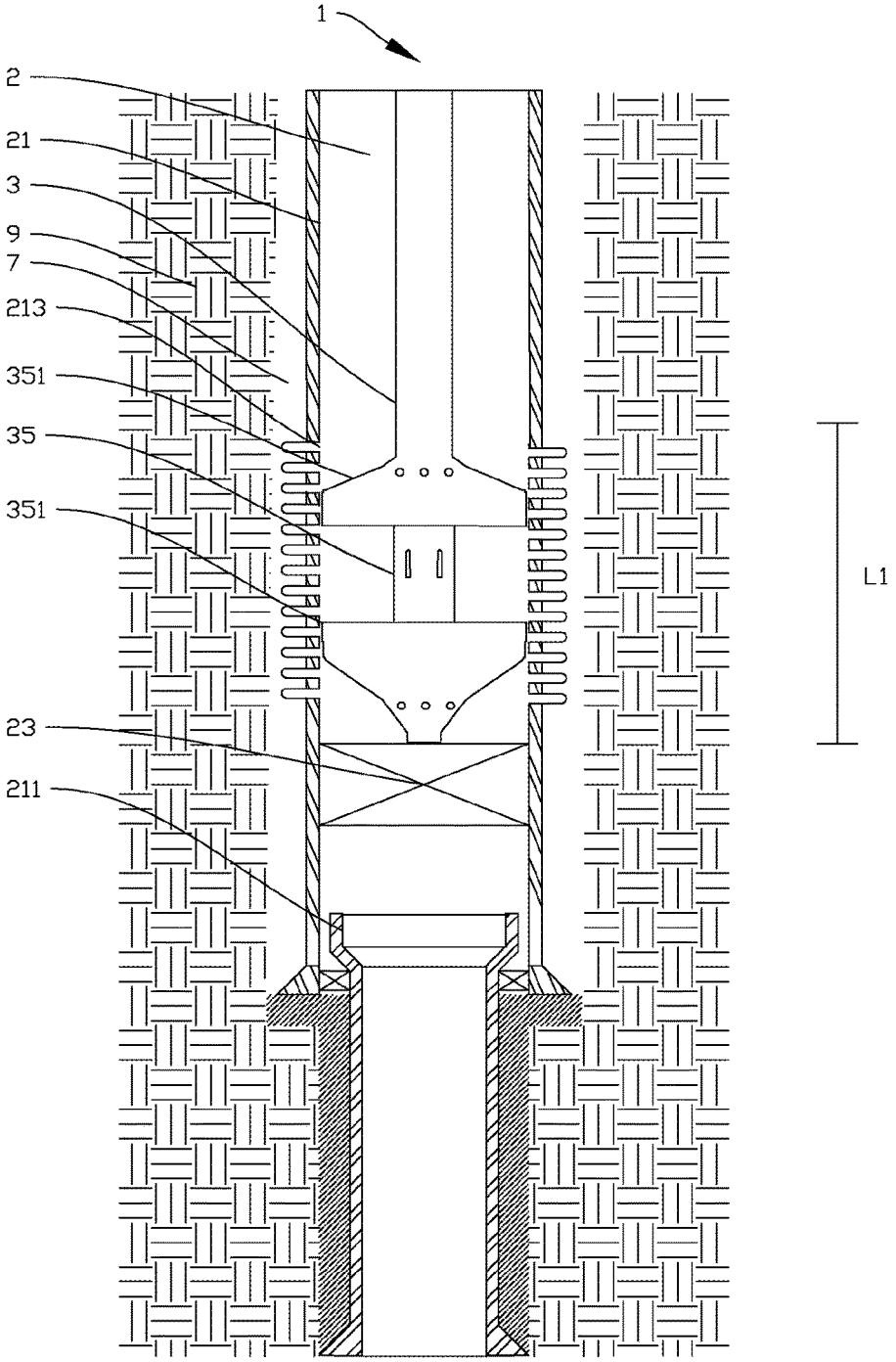
FIG. 4 shows, as viewed from the side, the well after having conducted a washing tool down into the well.
Figure 5:
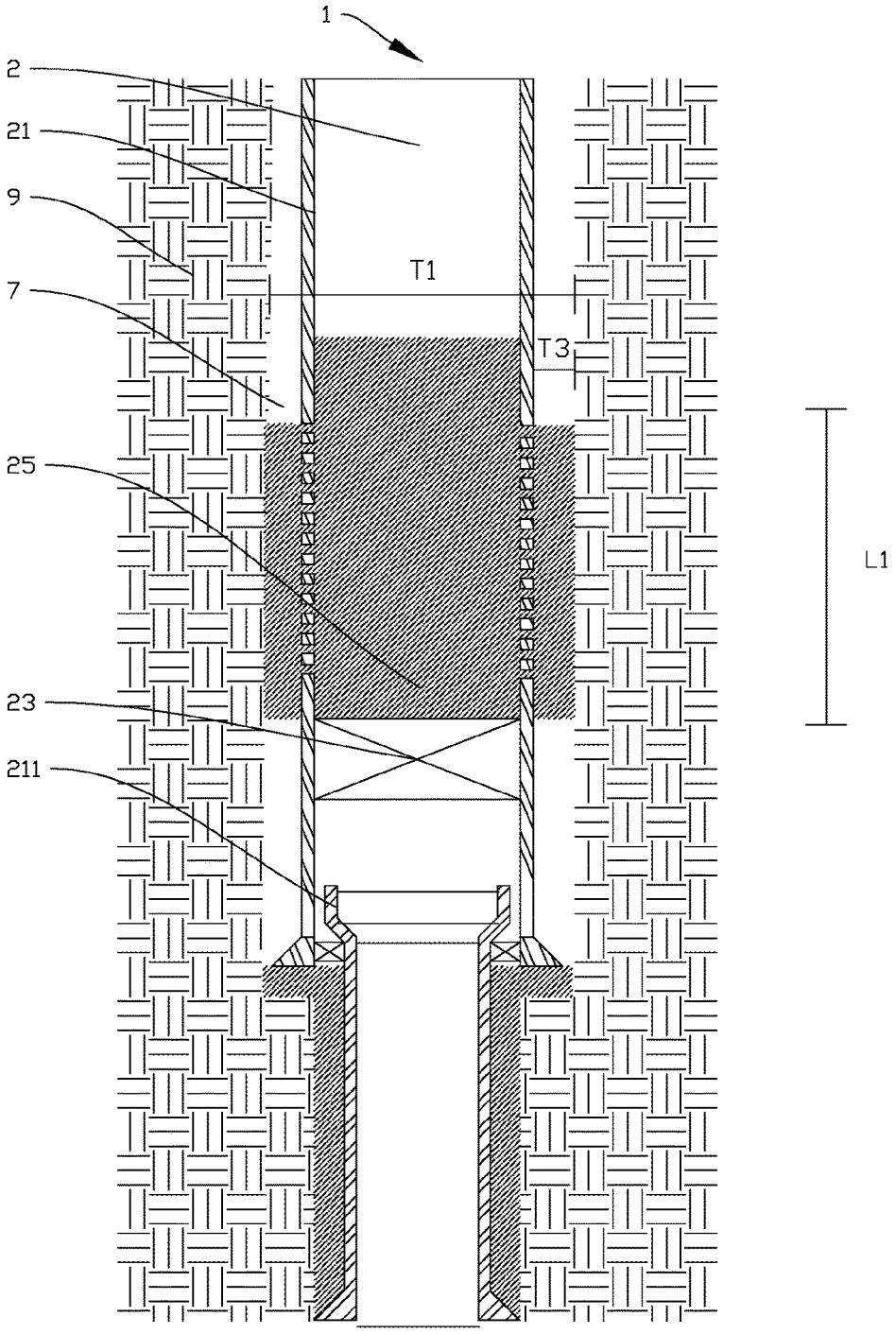
FIG. 5 shows, as viewed from the side, the well after having set a plug in the well.
Figure 6:
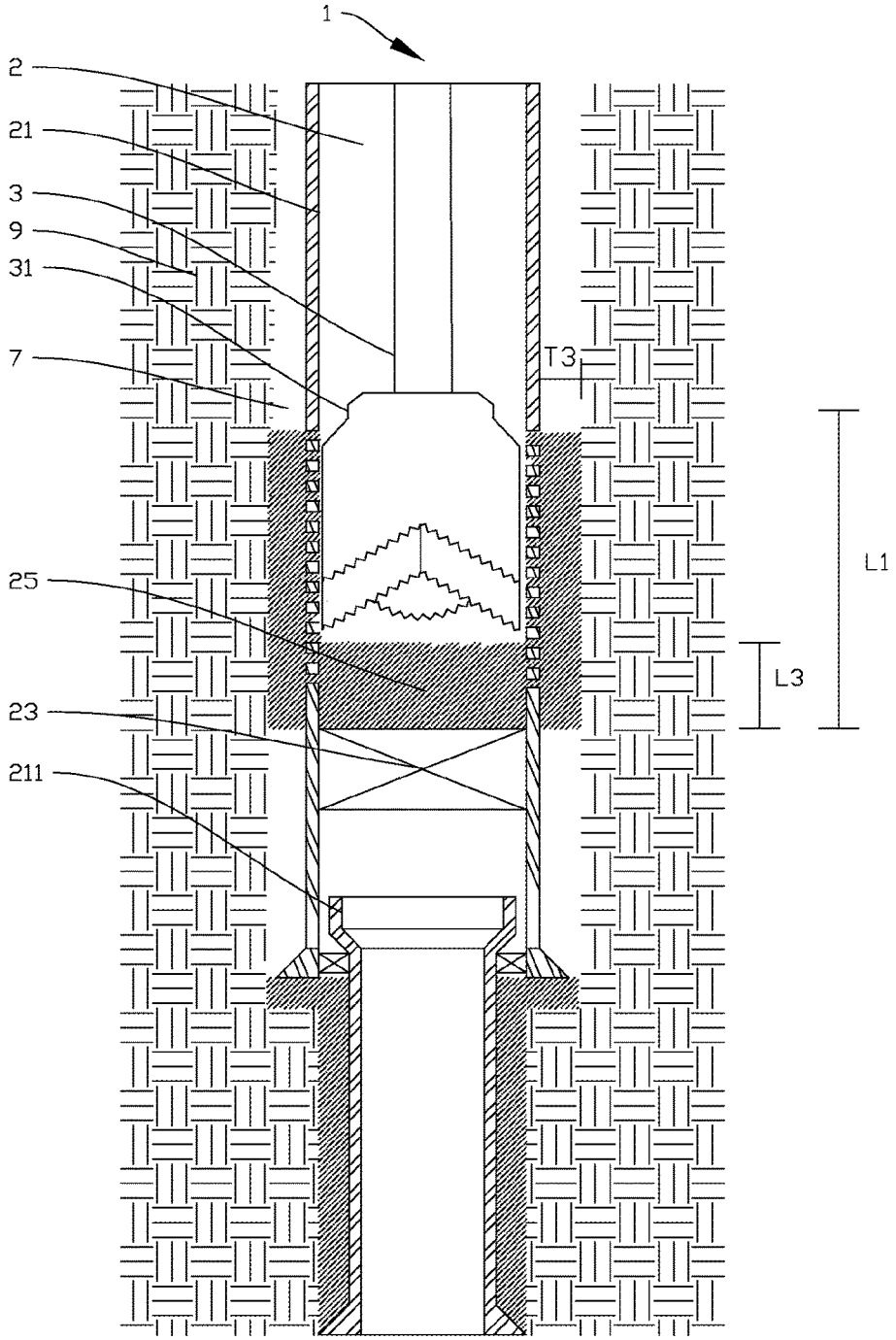
FIG. 6 shows, as viewed from the side, the well after having drilled away a portion of the plug.

A combined washing and plugging tool 35 is then conducted down into the well 1 and within the casing 21, as shown in FIG. 4. Perforating and washing and plugging may be carried out in the same trip or in separate trips down into the well 1. A washing fluid (not shown) is conducted through the string 3, out into the casing 21, and further out into the annulus 7 via the holes 213. The washing fluid is directed radially out into the annulus 7 by means of a directional means 351, as described in Norwegian patent application 20111641. A washing fluid at high velocity will be able to remove various particles, deposits and remnants from previous downhole operations, whereby the plugging material, which is to be conducted into the annulus 7 at a later stage, may flow freely and be adhered in a better way. Then a fluidized plugging material is pumped through the string 3 and out into the casing 21, and thus also into the annulus 7 via the holes 213 in the casing 21, whereby a plug 25 is formed along the longitudinal section L1, as shown in FIG. 5. The plug 25 extends, at least in a portion thereof, across the entire cross-section T1 of the well 1. It may be of advantage to use an apparatus of the type described in Norwegian patent application 20110450 to further displace and distribute the fluidized plugging material in the casing 21 and out into the annulus 7. The apparatus is not shown in the Figures associated with the present document.

n FIG. 6, the well 1 is shown after having drilled away a portion of the plug 25 by means of a drilling tool 31. After the drilling, a cross-sectional section T3 of the plug 25 remains along the entire length of the plug 25, whereas a longitudinal section L3 of the plug 25 remains at the bottom thereof, and against the plug base 23. The remaining longitudinal section L3 constitutes ca. ⅓ of the original length of the plug 25.

Figure 7:
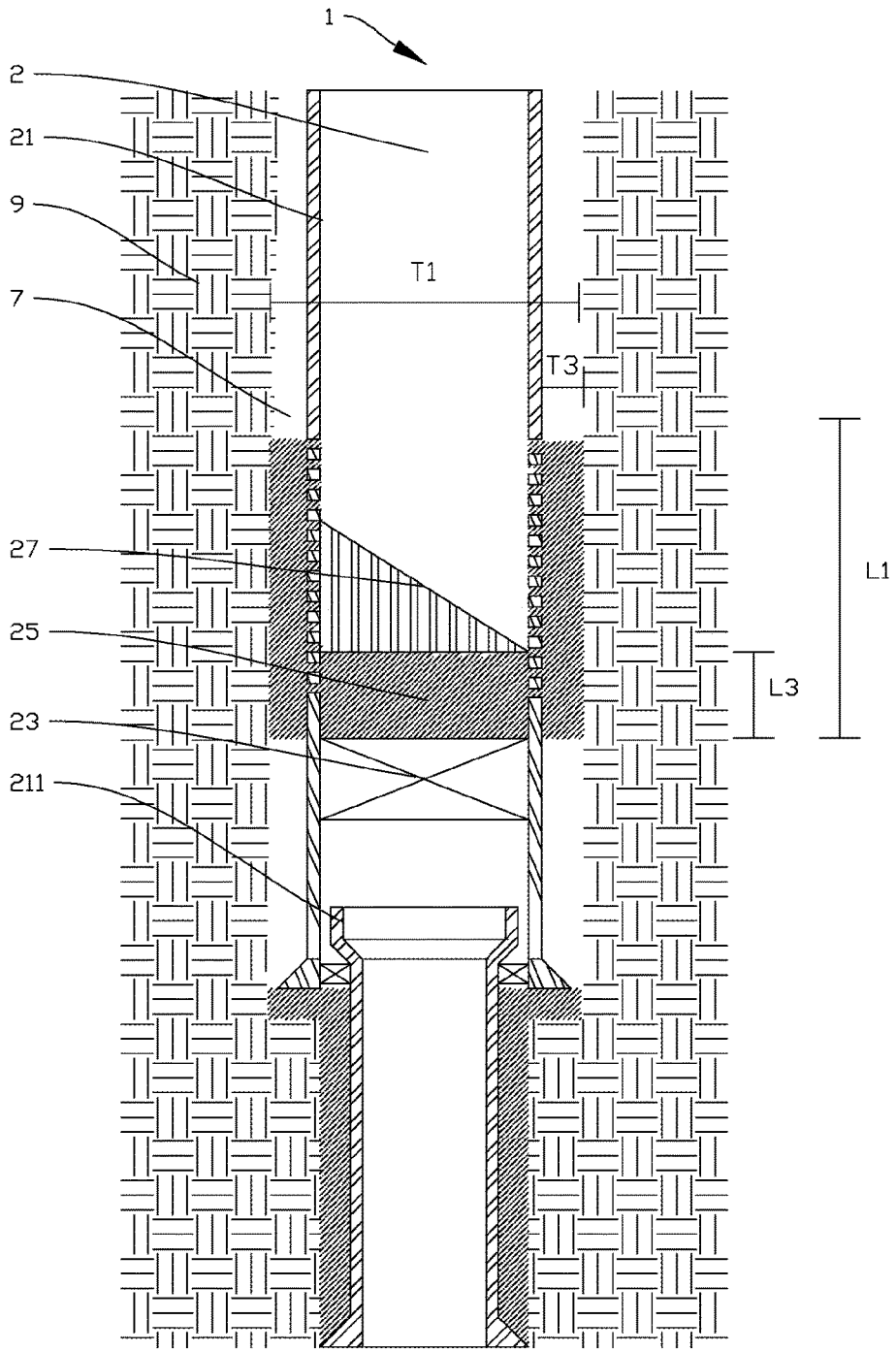
FIG. 7 shows, as viewed from the side, the well after having inserted a direction-guiding element in the well.
Figure 8:
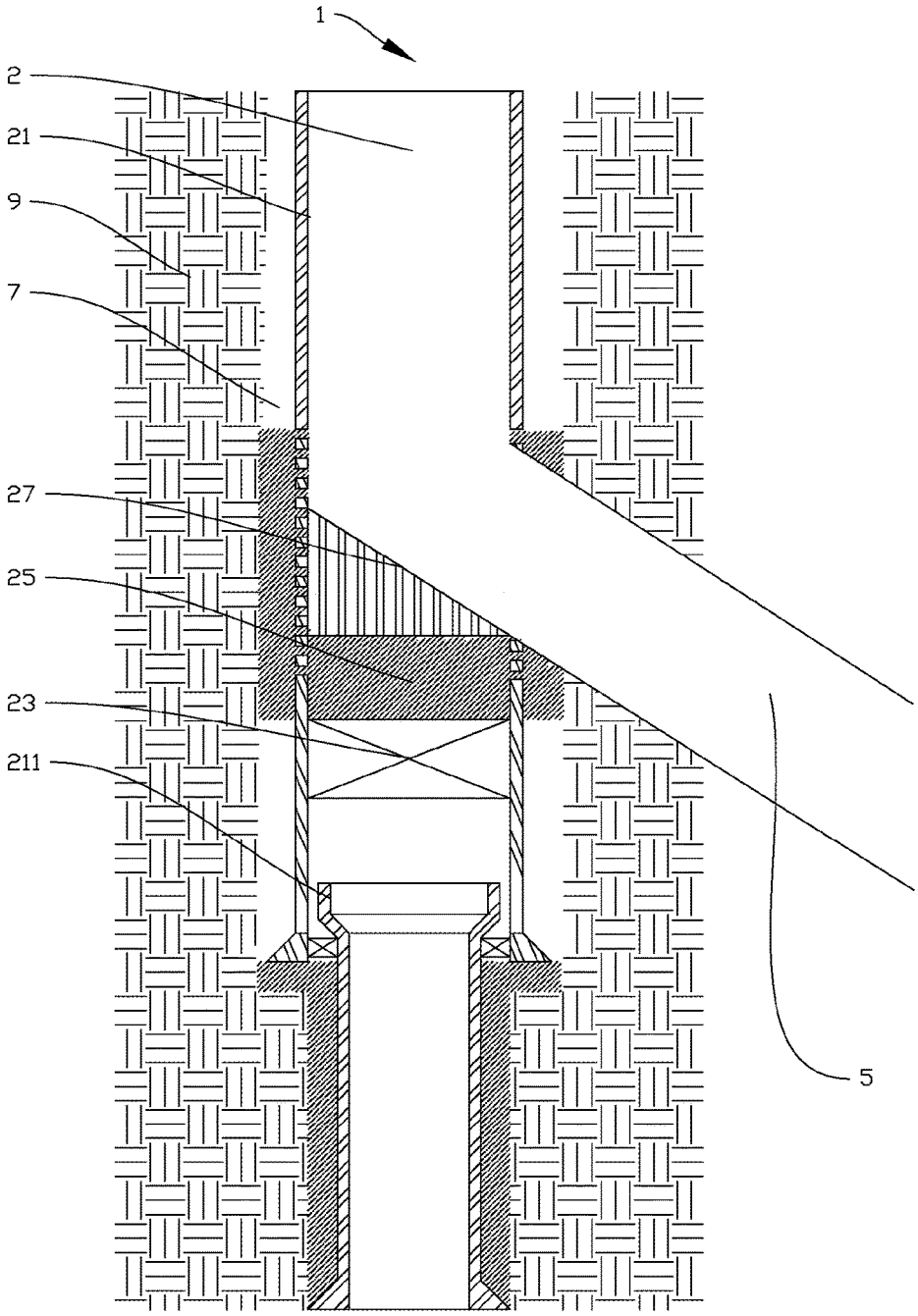
FIG. 8 shows, as viewed from the side, the well after having drilled a hole through the casing so as to open up to a new well path.

A direction-guiding element 27, here in the form of a whipstock, is placed on top of the remaining longitudinal section L3 of the plug 25, as shown in FIG. 7. The drilling tool 31 is then used to drill through the casing 21, and through the remaining cross-sectional section T3 of the plug 25, in a direction given by the geometric shape of the direction-guiding element 27. The drilling tool drills further into the formation 9 so as to form a new well path 5, as shown in FIG. 8.

The invention claimed is:

1. A method of providing mechanical stability around an entrance of a new well path to be formed from an existing well, and into a surrounding formation, the method comprising:

(A) disposing and anchoring a plug base below a first longitudinal section where the new well path is to be established in the existing well, wherein the existing well, at least along the first longitudinal section is delineated radially by a casing and an annulus defined between an outside of the casing and the surrounding formation, said annulus having accessible space for receiving a fluidized plugging material along the entire first longitudinal section;

(B) inserting said fluidized plugging material into the existing well and out into the annulus along the first longitudinal section and allowing the fluidized plugging material to form a plug of set plugging material which, at least in a portion of the plug, covers substantially the entire cross-section of the existing well, including the annulus between the outside of the casing and the surrounding formation, thereby providing said mechanical stability to the casing externally thereof along the first longitudinal section;

(C) after having set the plug in the existing well, removing a portion of the plug in such a manner that at least a cross-sectional section of the set plugging material remains in the annulus on the outside of the casing;

(D) disposing and anchoring a direction-guiding element in the existing well, and at least partially within the first longitudinal section; and (E) with the direction-guiding element, guiding a drilling tool against the inside of the casing in the existing well to form a primary hole through the casing, and further through the remaining cross-sectional section of set plugging material within the first longitudinal section, which opens up to formation of the new well path, wherein (B) also comprises:

(B1) conducting a perforation tool down into the casing and to the first longitudinal section where the plug is to be set;

(B2) with the perforation tool, forming perforation holes in the casing and along the first longitudinal section; and (B5) pumping said fluidized plugging material down through a string and out into the casing, thus also into the annulus outside the casing via the perforation holes in the casing, thereby forming said of set plugging material plug along the first longitudinal section.

2. The method according to claim 1, wherein (C) includes removing a portion of the plug in such a manner that a second longitudinal section of the plug remains centrally in the existing well and within the casing.

3. The method according to claim 2, wherein the second longitudinal section remaining centrally in the existing well constitutes less than half of the original length of the plug.

4. The method according to claim 1, wherein (C) includes removing the portion of the plug by means of drilling.

5. The method according to claim 1, wherein the plug is formed from a fluidized plugging material comprising cement slurry.

6. The method according claim 1, wherein the plug is formed from a fluidized plugging material comprising a particulate mass.

7. The method according to claim 1, wherein (B), and between (B2) and (B5), also includes the following:

(B3) with a washing tool, which is attached to a flow-through string and is conducted down to the first longitudinal section, pumping a washing fluid down through the string and out into the casing via the washing tool; and (B4) with a directional means connected to the washing tool, conducting the washing fluid out into the annulus between the outside of the casing and the surrounding formation.

8. The method according to claim 7, wherein a displacement body is used to further displace and distribute the fluidized plugging material in the casing and further out into the annulus.

9. The method according to claim 7, wherein (B2) and (B3, B4) are *carried out in separate trips down into the existing well.

10. The method according to claim 7, wherein (B2) and (B3, B4) are carried out in one and the same trip down into the existing well.

11. The method according to claim 7, wherein the method further comprises leaving the perforation tool in the existing well.

12. The method according to claim 7, wherein the method further comprises leaving the washing tool in the existing well.

13. The method according to claim 1, wherein the method, after (E), also comprises drilling out the new well path via the primary hole formed through the casing and further through the cross-sectional section of set plugging material within the first longitudinal section.

* * * * *